United States Patent [19]

Walker

[11] 4,292,714

[45] Oct. 6, 1981

[54] EASY OPENING AND SECURE CLOSING CLOSURE

[76] Inventor: Robert J. Walker, 2942 Linden Ave., Berkeley, Calif. 94705

[21] Appl. No.: 111,901

[22] Filed: Jan. 14, 1980

[51] Int. Cl.[3] ..... B65D 77/10; B65D 33/16

[52] U.S. Cl. ..... 24/30.5 R; 24/30.5 S; 24/30.5 T; 24/30.5 P; 24/255 BS; 229/62

[58] Field of Search ..... 24/30.5 R, 30.5 S, 30.5 T, 24/30.5 L, 30.5 P, 206 A, 255 BS; 150/3; 229/62

[56] References Cited

U.S. PATENT DOCUMENTS

| | | | |
|---|---|---|---|
| 2,029,043 | 1/1936 | Wendell et al. | 24/255 BS |
| 2,460,963 | 2/1949 | Young | 24/30.5 S |
| 2,981,990 | 5/1961 | Balderree, Jr. | 24/30.5 S |
| 3,140,519 | 7/1964 | Johnson | 24/30.5 R |
| 3,170,213 | 2/1965 | Thomas, Jr. | 24/30.5 S |
| 3,348,595 | 10/1967 | Stevens, Jr. | 24/30.5 S |
| 3,357,070 | 12/1967 | Sloan | 24/30.5 S |
| 3,417,912 | 12/1968 | Paxton | 24/30.5 S |
| 3,822,441 | 7/1974 | Paxton | 24/30.5 S |

FOREIGN PATENT DOCUMENTS

| | | | |
|---|---|---|---|
| 571439 | 3/1959 | Canada | 24/30.5 T |
| 1399004 | 6/1975 | United Kingdom | 24/30.5 L |

*Primary Examiner*—Victor N. Sakran

*Attorney, Agent, or Firm*—Edward B. Gregg; Willis E. Higgins

[57] ABSTRACT

A fastener or closure is formed of flexible material having a portion which is deformable from a first fixed configuration to a second configuration. Two projections are spaced apart one from the other when the deformable portion is in one of its configurations, and are sufficiently close when the deformable portion is in its other configuration to prevent removal of a fastened article from the fastener. In this manner, both easy opening and secure closing are obtained with the closure.

20 Claims, 6 Drawing Figures

EASY OPENING AND SECURE CLOSING CLOSURE

BACKGROUND OF THE INVENTION

1. Field of the Invention

This invention relates to a fastener or a closure especially adapted for use with bags and other flexible containers. More particularly, it relates to an improved form of fastener or closure which is both easy to open and close securely. Most especially, it relates to such a closure or fastener which is formed of flexible material.

2. Description of the prior art.

Closures for use with bags and similar flexible containers and formed from a small sheet of plastic material have been known for many years. Examples of such closures are disclosed in U.S. Pat. Nos. 2,122,477; 2,907,286; 3,348,595; and 4,026,418. With such closures, users sometimes experience difficulty in removing and reapplying the closures, and, therefore, they often discard them in favor of twist ties, rubber bands, and the like, or simply do without a closure. Thus, while the art pertaining to such closures is a well developed one, a need still remains for further improvement in them.

SUMMARY OF THE INVENTION

Accordingly, it is an object of this invention to provide a fastener of simplified construction having positive engagement and disengagement.

It is another object of this invention to provide a bag closure that can be easily opened and closed with one hand.

It is a further object of the invention to provide a bag closure that is not subject to breakage after repeated opening and closing in normal usage.

The attainment of these and related objects may be achieved through the use of the novel fastener or closure herein disclosed. The fastener or closure comprises a sheet of flexible material, which may be either a suitable metal or plastic. The sheet has a portion which is deformable from a first fixed configuration to a second configuration. It has a pair of projections which are spaced apart when the deformable portion is in one of its configurations, and which are sufficiently close to prevent removal of a fastened article or are engaged when the deformable portion is in its other configuration. The deformable portion is preferably dome-shaped and extends in one direction above the sheet in its first fixed configuration. It is flexed to extend in an opposite direction from the sheet in its second configuration. The pair of projections are preferably formed in a part of the sheet separated from the remainder of the sheet by a transverse bend, desirably forming approximately a 90 degree angle, so that the part extends substantially at right angles from the remainder of the sheet. In this embodiment, the transverse bend is desirably tangent to the edge of the dome-shaped portion.

The fastener may be made in either a normally opened or a normally closed configuration. If the dome-shaped portion extends in the same direction above the sheet as the projections, they are normally open, but become engaged when the dome is deformed to extend in the opposite direction from the sheet as the projections. Correspondingly, if the dome-shaped portion is fabricated to extend in the opposite direction from the sheet as the projections, the projections are normally closed or engaged and are then opened by flexing the dome to extend above the sheet in the same direction as the projections.

The attainment of the foregoing and related objects, advantages and features of the invention should be more readily apparent to those skilled in the art after review of the following more detailed description of the invention, taken together with the drawings in which, FIG. 1 is a perspective view of a first embodiment of the invention in its normal configuration.

DETAILED DESCRIPTION OF THE INVENTION

Figure 1:
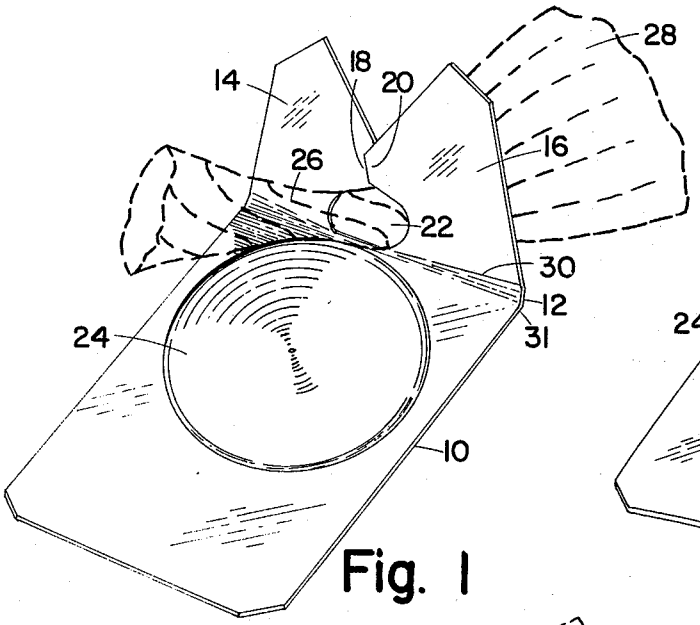
Figure 2:
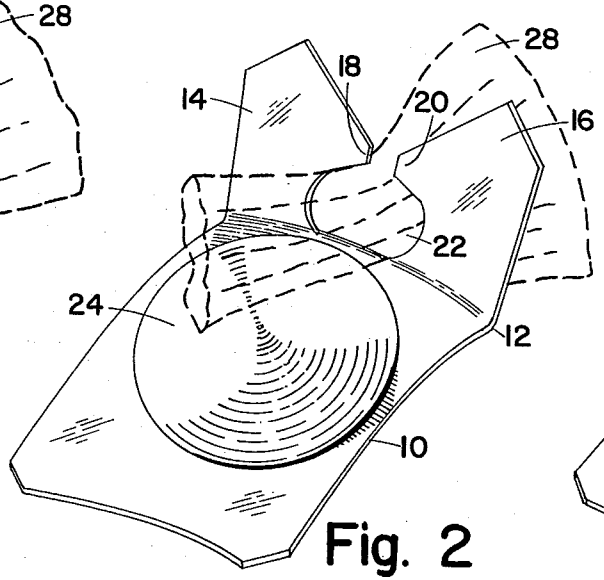
FIG. 2 is a perspective view of the embodiment of FIG. 1, but in its deformed position.

Turning now to the drawings, more particularly to FIGS. 1 and 2, there is shown an embodiment of a normally closed bag closure or fastener in accordance with the invention. The closure is formed from a single sheet 10 of a suitable flexible metal or plastic. The sheet 10 has a transverse bend 12, so that projections or jaws 14 and 16 extend at substantially right angles to the remainder of sheet 10. The bend 12 need not be a right angle. Angles as shallow as 45 degrees with the horizontal are operable. The projections 14 and 16 desirably have parts 18 and 20, each extending toward the other projection 16 or 14. In this manner, the projections form a centrally disposed opening 22. The sheet 10 has a dome-shaped portion 24 proximate to the projections 14 and 16. It should be noted that the dome-shaped portion 24 extends away from the sheet 10 in the opposite direction from projections 14 and 16 shown in FIG. 1. The dome-shaped portion is also preferably formed so that it is substantially tangent to the bend 12. This relationship is particularly advantageous, because, as a result of deformation of the dome-shaped portion 24 in initially flat sheet 10, the sheet 10 is bowed slightly as shown in FIG. 2, thus opening the projections 18 and 20 on jaws 14 and 16, which overlap slightly to produce a normally closed closure, when sheet 10 is unbowed.

The twisted neck 26 of a plastic or cellophane bag 28 is thus held closed securely by the projections 14 and 16. The bowing of sheet 10 is the greatest near the dome shaped portion 24. While the bowing is usually sufficient if the bend is spaced away from the dome shaped portion 24, operability is assured if it is tangent thereto.

In addition to the right angle bend 12, projections 14 and 16 are desirably crimped upward at their outer edges, as indicated at 30, so that the parts 18 and 20 overlap as shown in FIG. 1, to assure positive retention of the neck 26 of bag 28.

FIG. 2 shows the bag closure of FIG. 1 in its opened position. This position is achieved by flexing the dome-shaped portion 24 from its normal position shown in FIG. 1 to the position shown in FIG. 2, in which the dome-shaped portion 24 extends upward from the sheet 10 in the same direction as the projections 14 and 16. Dome 24 is flexed to the position shown in FIG. 2 when it is desired to open the bag 28, as well as during the initial packaging, when it is desired to insert the neck 26 of the bag into the opening 22. To close the bag 28, the twisted neck 26 is reinserted in the opening 22, and the dome 24 is flexed back to its original position as shown in FIG. 1, thus moving the projections 18 and 20 back to their engaged positions.

Figure 3:
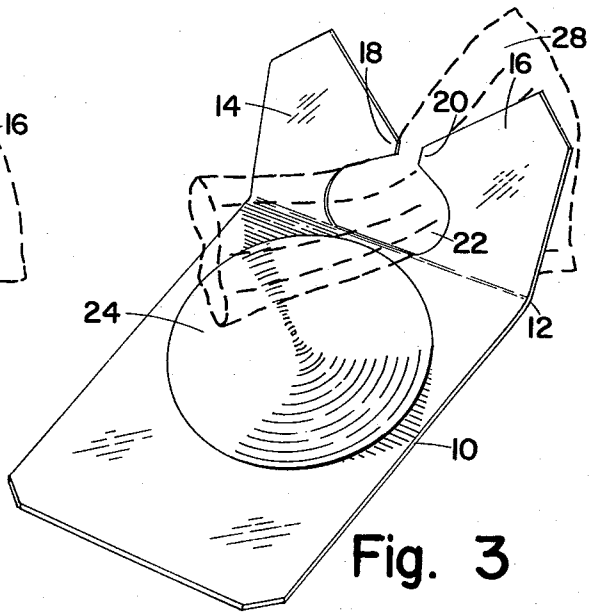
FIG. 3 is a similar perspective of another embodiment of the invention in its normal position.
Figure 4:
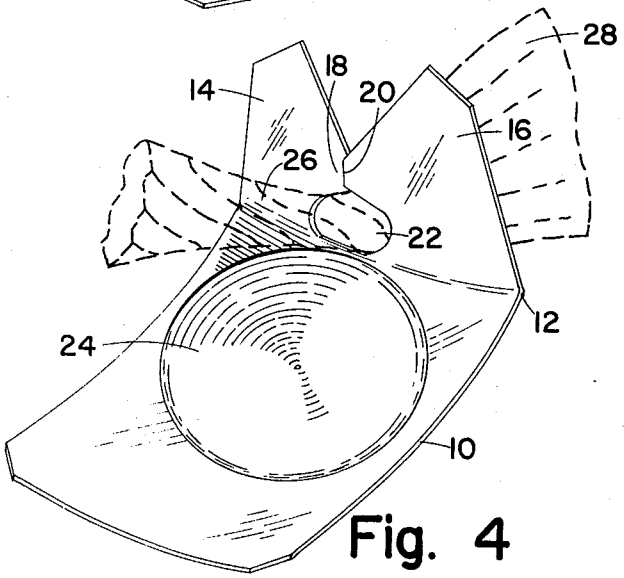
FIG. 4 is a similar perspective view of the embodiment of FIG. 3, but in its deformed position.

FIGS. 3 and 4 show another embodiment of a bag closure in accordance with the invention, which is very similar to the embodiment in FIGS. 1 and 2, but which is normally opened rather than normally closed. For convenience, the same reference numbers are used for corresponding elements in FIGS. 1 and 2. This form of the invention is used in situations where a flexible bag 28 or similar container is usually open, but is to be closed for short periods of time. The normally opened closure is obtained by having the dome-shaped portion 24 extend away from the sheet 10 in the same direction as the projections 14 and 16 as fabricated. The deformation of the dome-shaped portion 24 in the opposite direction from the projections 14 and 16, as shown in FIG. 4, then causes the parts 18 and 20 of the projections 14 and 16 to overlap as shown in FIG. 4. This difference in the dome is employed for providing normally closed and normally opened versions of the invention because plastics and similar materials used to form the closure tend to have a "memory" for their initial formation position, so that the embodiment of FIGS. 3 & 4, for example, might start to open spontaneously if left in the closed position of FIG. 4 for a substantial length of time.

Figure 5:
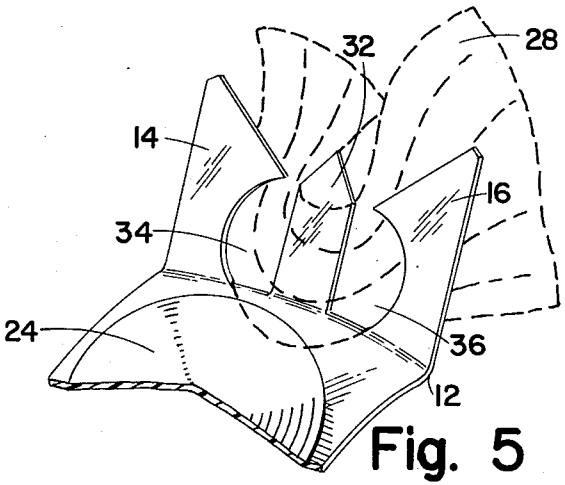
FIG. 5 is a perspective view of a portion of another embodiment of the invention in its open position.
Figure 6:
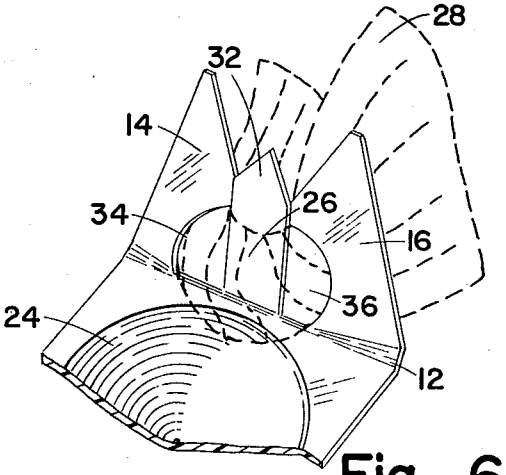
FIG. 6 is a perspective view of the portion shown in FIG. 5 in its closed position.

FIGS. 5 and 6 show a portion of another embodiment of the invention, which enables a tighter closing of the bag 28. In this embodiment, projections 14 and 16 are each disposed on one side of a third, centrally disposed projection 32. As shown in FIG. 5, the twisted neck 26 of the bag 28 is inserted in one direction into opening 34 on one side of third projection 32, then passed through opening 36 on the other side of third projection 32 in the other direction. When the closure is in its closed position, as shown in FIG. 6, the neck 26 of the bag 28 is securely grasped in two places, thus assuring that the portion of the neck 26 between the two openings 34 and 36 remains twisted. The neck 26 is easily inserted into and removed from the openings 34 and 36 when the closure is in its open position, as shown in FIG. 5. The base portion including the dome 24 in this embodiment can have either form shown in FIGS. 1–4.

The closure structure as shown in FIGS. 1–6 may be fabricated of any flat sheet material, such as a metal or plastic, which permits flexing or inversion of the dome portion 24. For example, any of several well known synthetic resinous plastic materials may be employed, which have the necessary characteristics of being ductile and non brittle, for example, having a yield point of 5 to 10% and an ultimate elongation of 50% or more. Suitable specific examples of such plastics include rigid (i.e. unplasticized) polyvinyl chlorides, high impact polystyrenes, some polypropylenes, high density polyethylenes and polycarbonates. The rigid polyvinyl chloride compositions are the presently preferred plastics, since their performance characteristics are easily engineered to meet special functional requirements. In practice, flat stock may be cut to the required shape, then either thermoformed or cold formed to produce the bend 12, the dome portion 24, and the upward crimp 30, if desired. If the upward crimp 30 is to be provided, it is desirably formed by bending edges 31 upward slightly after forming the right angle bend 12. It has been determined that suitable polyvinyl chloride sheet material is heat sensitive above 160° F. if cold forming is employed to fabricate the closures. However, if thermoforming is employed there is apparently a sufficient modification of the polymer molecule produced so that heat sensitivity is not a problem. Alternatively, injection molding of the structures from plastic resin may be carried out.

In a specific example, closures may be formed from sheets of 0.020 inch thick commercially available rigid polyvinyl chloride having dimensions of 2 inches by 1 inch, with the right angle bend $\frac{5}{8}$ inch from one end. The dome height is $\frac{1}{8}$ inch, the dome diameter is $\frac{7}{8}$ inch, and the radius of the dome is $\frac{3}{4}$ inch.

The closures shown in FIGS. 1–6 are particularly adapted for use as flexible bag closures. The novel concept embodied in these closures may be employed with fasteners or closures designed for other purposes as well. For example, a novelty key holder could be provided using a deformable portion having two different positions for opening and closing the key holder. Another potential application is as a wire holder for automotive, electronic and related applications in which the fastener could be attached on the automobile or electronic chassis or engine block and might be fabricated of steel, aluminum, or other suitable metal sheets. Such a fastener would provide a positive holding of the wires, yet allow their easy release for engine repairs and other automotive and electronic maintenance.

It should now be apparent to those skilled in the art that a novel closure or fastener capable of achieving the stated objects of the invention has been provided. The fastener is of a simple, one piece construction with positive engagement and disengagement which is easily accomplished using one hand. It is further not subject to breakage after repeated opening and closing in normal use.

It should be further apparent to those skilled in the art that various changes in form and details of the invention as shown in the drawing may be made. It is intended that such changes be included within the spirit and scope of claims appended hereto.

What is claimed is:

1. A fastener, which comprises flexible material having a dome-shaped portion which is reversibly deformable from a first fixed configuration extending in one direction above its surrounding material to a second configuration extending in an opposite direction, and a pair of projections formed in said material, each projection being separated by a transverse bend from the dome-shaped portion, the bend being substantially tangent to an edge of the dome-shaped portion, the projections being spaced apart a sufficient amount to allow insertion and removal of a fastened article when the portion is in one of its configurations and sufficiently close when the portion is in its other configuration to prevent removal of a fastened article from the fastener.

2. The fastener of claim 1 in which the projections are close when the dome-shaped portion extends in its original direction as formed and are spaced apart when the dome-shaped portion is flexed to extend in the opposite direction.

3. The fastener of claim 1 in which the projections are spaced apart when the dome-shaped portion extends in its original direction as formed and are engaged when the dome-shaped portion is flexed to extend in the opposite direction.

4. A fastener, which comprises flexible material having a portion which is reversibly deformable from a first fixed configuration to a second configuration, a pair of projections, and a third projection between and substantially parallel to said pair of projections, each of said pair of projections becoming alternately spaced apart from said third projection to allow insertion and removal of a fastened article when the portion is in one of its configurations and close to the third projection as the portion is deformed to its second configuration, thereby to grasp the fastened article in two places and prevent removal of the fastened article from the fastener.

5. The fastener of claim 1 in which the flexible material is a plastic.

6. The fastener of claim 1 in which the flexible material is a rigid polyvinyl chloride.

7. A bag closure, which comprises a sheet of flexible material having a pair of normally closed projections extending at a substantially right angle to the remainder of the sheet, and a dome-shaped portion in the remainder of the sheet, substantially tangent to the bend forming the right angle, the dome shaped portion extending in the opposite direction from the remainder of the sheet as the projections, flexing of the dome-shaped portion to extend in the same direction as the projections causing them to become spaced apart.

8. A bag closure, which comprises a sheet of flexible material having a pair of normally spaced apart projections extending at a substantially right angle to the remainder of the sheet, and a dome shaped portion in the remainder of the sheet substantially tangent to the bend forming the right angle, the dome shaped portion extending in the same direction from the remainder of the sheet as the projections, flexing of the dome shaped portion to extend in the opposite direction as the projections causing them to become closed.

9. The bag closure of claim 7 or 8 in which the projections each have a portion extending toward the other projection, so that the projections and said sheet form an enclosed opening when the projections are closed.

10. The bag closure of claim 7 or 8 in which the flexible material is a plastic.

11. The bag closure of claim 10 in which the plastic comprises a rigid polyvinyl chloride.

12. A fastener comprising a strip of flexible sheet material having an angular shape providing a substantially planar base portion and a substantially planar fastener portion separated one from the other by a transverse bend in the sheet of material, said base portion being formed with a dome which by application of manual pressure can be snapped back and forth between a first position projecting from one face of the base portion and a second position projecting from the other face of the base portion, said fastener portion being formed with a pair of fingers spaced apart to provide an opening to receive and encircle an article to be fastened, said fingers being capable of assuming an open position separated at their extremities sufficiently to allow insertion and removal of an article to be fastened and a closed position with their extremities sufficiently close to one another to prevent detachment of a fastened article, the material of the base portion being such that movement of the dome between said positions can be accomplished by manual pressure accompanied by a snapping movement, the proximity of the dome, the bend and the fingers being such that when the dome is snapped to one position the fingers will be in their open position and when it is snapped to the other position the fingers are in their closed position.

13. The fastener of claim 12 in which the dome normally projects from the base portion in an opposite direction from the fastener portion and the pair of fingers are normally closed.

14. The fastener of claim 12 in which the dome normally projects from the base portion in the same direction as the fastener portion and the pair of fingers are normally open.

15. A bag closure comprising a strip of flexible sheet material having an angular shape providing a substantially planar base portion and a substantially planar fastener portion separated one from the other by a transverse bend in the sheet of material, said base portion being formed with a dome which by application of manual pressure can be snapped back and forth between a first position projecting from one face of the base portion and a second position projecting from the other face of the base portion, said fastener portion being formed with three fingers spaced apart to provide two openings to receive and encircle a neck of the bag in two places, said fingers being capable of assuming an open position separated at their extremities sufficiently to allow insertion and removal of the neck of the bag and a closed position with their extremities sufficiently close to one another to prevent detachment of the neck of the bag, the material of the base portion being such that movement of the dome between said positions can be accomplished by manual pressure accompanied by a snapping movement, the proximity of the dome, the bend and the fingers being such that when the dome is snapped to one position the fingers will be in their open position and when it is snapped to the other position the fingers are in their closed position.

16. The fastener of claim 15 in which the dome normally projects from the base portion in an opposite direction from the fastener portion and the fingers are normally closed.

17. The fastener of claim 15 in which the dome normally projects from the base portion in the same direction as the fastener portion and the fingers are normally open.

18. A method for fastening an article which comprises the steps of: providing a fastener having at least two projections and a reversibly deformable dome-shaped portion of flexible material, separated from each projection by a transverse bend in the flexible material substantially tangent to the dome-shaped portion, deforming the dome-shaped portion to one of its positions to move the projections apart, inserting the article to be fastened between the projections, and deforming the portion to its other position to move the projections toward one another sufficiently to hold the article to be fastened.

19. The method of claim 18 in which the article to be fastened is a bag.

20. The method of claim 18 in which the fastener has at least three projections, the article is a bag having a neck, the neck is inserted between the projections in two places, and the projections grasp the neck in two places when the projections move toward one another.

* * * * *